US006101953A

United States Patent [19]

Spata

[11] Patent Number: 6,101,953

[45] Date of Patent: Aug. 15, 2000

[54] APPARATUS TO FACILITATE RAIL TRANSIT BY MOTOR VEHICLES

[76] Inventor: Stephen Christopher Spata, 2079 Harvard, Berkley, Mich. 48072-1779

[21] Appl. No.: 08/976,743

[22] Filed: Nov. 24, 1997

[51] Int. Cl.[7] ..... B61C 11/00

[52] U.S. Cl. ..... 105/215.2; 105/215.1; 105/355; 105/72.2; 410/4; 180/198; 414/537

[58] Field of Search ..... 410/4; 254/8 C, 254/9 C; 105/355, 392, 215.1, 215.2, 72.2; 280/415.1; 180/198; 414/537

[56] References Cited

U.S. PATENT DOCUMENTS

| | | | |
|---|---|---|---|
| 881,008 | 3/1908 | Knut . | |
| 1,080,673 | 12/1913 | Belanger . | |
| 1,107,825 | 8/1914 | Morris . | |
| 1,180,476 | 4/1916 | Cook et al. . | |
| 1,286,846 | 12/1918 | Wales . | |
| 1,301,294 | 4/1919 | Morris . | |
| 1,348,324 | 8/1920 | Scully . | |
| 1,356,473 | 10/1920 | Schofield . | |
| 1,356,475 | 10/1920 | Schofield . | |
| 1,371,819 | 3/1921 | Smith . | |
| 1,396,785 | 11/1921 | Schofield . | |
| 2,564,311 | 8/1951 | Rimailho | 105/215.2 |
| 2,768,020 | 10/1956 | Sylvester . | |
| 3,057,306 | 10/1962 | Hatfield . | |
| 3,086,483 | 4/1963 | Scheldrup . | |
| 3,306,175 | 2/1967 | Ferwerda . | |
| 3,610,169 | 10/1971 | Shannon . | |
| 3,653,332 | 4/1972 | Olson, Sr. et al. | 105/72.2 |
| 3,791,491 | 2/1974 | Tickle . | |
| 3,856,319 | 12/1974 | Hardy . | |
| 3,881,577 | 5/1975 | Wherry et al. . | |
| 3,926,272 | 12/1975 | Weber . | |
| 3,960,400 | 6/1976 | Licht et al. . | |
| 3,980,025 | 9/1976 | Olson, Sr. et al. . | |
| 4,084,859 | 4/1978 | Bull et al. . | |
| 4,099,790 | 7/1978 | Hipps . | |
| 4,163,586 | 8/1979 | Snyder . | |
| 4,266,483 | 5/1981 | Rannanmaki . | |
| 4,295,687 | 10/1981 | Becker et al. . | |
| 4,307,910 | 12/1981 | Rodney . | |
| 4,346,790 | 8/1982 | Morrison et al. . | |
| 4,391,343 | 7/1983 | Deare . | |
| 4,415,055 | 11/1983 | Ahn . | |
| 4,497,257 | 2/1985 | White, Jr. . | |
| 4,607,996 | 8/1986 | Koch | 410/4 X |
| 4,721,430 | 1/1988 | Littke et al. . | |
| 5,072,805 | 12/1991 | Meiners . | |
| 5,097,770 | 3/1992 | Miyashita et al. . | |
| 5,154,124 | 10/1992 | Madison . | |
| 5,257,894 | 11/1993 | Grant | 414/537 |
| 5,295,736 | 3/1994 | Brearley | 303/7 |
| 5,333,926 | 8/1994 | Christie et al. . | |
| 5,375,532 | 12/1994 | Larson, Jr. | 105/72.2 |
| 5,727,474 | 3/1998 | Theurer et al. | 105/355 |
| 5,802,980 | 9/1998 | Hofmiller | 105/72.2 |

FOREIGN PATENT DOCUMENTS

| | | | |
|---|---|---|---|
| 607714 | 9/1948 | United Kingdom | 254/9 C |

*Primary Examiner*—Stephen T. Gordon
*Attorney, Agent, or Firm*—Paul S. Czarnota

[57] ABSTRACT

An apparatus for facilitating the travel of a motor vehicle, designed for roadway travel, upon railways has the capacity to be towed to the rail site by the motor vehicle. The apparatus has a platform having at least one rotatable axle of roadway tires attached thereto. In the deployed position, the roadway wheels allow the apparatus to be towed similarly to a trailer. When the apparatus is properly positioned over a railroad crossing, the rotatable wheels are drawn back to a retraced position, the apparatus is lowered so that rail wheels, mounted to the platform, engage the rails exactly as other rail vehicles. A removable ramp allows the motor vehicle to mount the platform. The wheels of the motor vehicle engage either one or two sets of rollers disposed upon the platform. After the motor vehicle is properly secured, the motor vehicle can be engaged to drive the rollers, with the power delivered to the rollers being transmitted to the train wheels to supply the necessary locomotion. To accommodate various motor vehicles of differing offsets between the driven axles, the distance between the two sets of rollers may be adjusted, and each may receive rotational power from one axle of the vehicle and transmit that energy to one of the sets of train wheels of the apparatus to propel the apparatus down the railways, and thus either end of the apparatus may serve as the forward end of the apparatus when it is upon a railway.

23 Claims, 4 Drawing Sheets

APPARATUS TO FACILITATE RAIL TRANSIT BY MOTOR VEHICLES

BACKGROUND OF THE INVENTION

1. Field of the Invention

The present invention concerns apparatuses to facilitate travel of motor vehicles upon standard gauge rail lines. More particularly, the present invention concerns apparatuses which are adaptable to travel either upon rail lines or upon surface roads. Even more particularly, the present invention concerns an apparatus which can be pulled by a motor vehicle on surface roads, in like manner to a trailer, and can also be deployed upon a railway, with the motor vehicle mounted thereupon and providing the locomotion for the apparatus to travel upon rail lines.

2. Background of the Prior Art

Much of the United States, particularly the areas west of the Mississippi River, were opened for settlement by the building of the railroad lines. In the last 150 years, rail lines have been established that cover virtually every corner of the country. Even with the ascendancy of the automobile and the truck, both pick-up and freight, and the resulting shift in passenger traffic away from the train, the railways remain vital channels for commerce to flow across the nation, and particularly to transport resources, food stuffs and heavy industrial goods.

To maintain these interstate rails, the railroad community regularly inspects and repairs the individual lines and routes. In past days, inspectors either used hand cars or locomotives to slowly traverse the rails. These methods are unsuitable today. Instead, a variety of approaches have been attempted to economically and efficiently transport inspectors and work crews to spots along the rails.

One somewhat recent attempt to address this need is found in U.S. Pat. No. 3,086,483, issued Apr. 23, 1963 to Scheldrup and is entitled "RAIL MOUNTED APPARATUS FOR HIGHWAY VEHICLES". Scheldrup teaches the use of a pair of dual-axle carriages that may be deployed upon the rails, and which are capable of transport thereon. A land-based, two axle motor vehicle is then positioned on the carriages, such that each axle of the vehicle is mounted upon one carriage. The rotation of the drive wheels of the vehicle transmits the force for rotation to the carriage upon which it is mounted to drive the vehicle on the rails.

The preferred modern approach has been to utilize a road vehicle, and especially a truck, that is modified so as to be capable of traversing rail lines via equipment mounted upon the vehicle. One such example can be found in U.S. Pat. No. 3,980,025, issued to Olson. In Olson, rotatable guide wheels are lowered from the body of the truck, normally at the front of the truck. These wheels interact with the track to keep the vehicle on line. The tires of the truck contact the tops of the rails; this is where the traction for vehicular locomotion is supplied.

One drawback in this approach is that the vehicle must be specially made, usually at a significant additional cost. Further, road vehicles such as trucks are not designed for rail travel. Thus, a heavy toll is borne by the vehicle, which deteriorates more rapidly than would otherwise be anticipated. This can affect negatively the safety of the vehicle, including situations where the permanent alteration of the vehicle impairs airbag deployment. Not insignificantly, but logically, warranties issued by the truck manufacturers are usually voided when such modifications are made, and with a resulting decline in vehicle resale value.

Additionally, functionality in many aspects, such as steering, handling and braking, are at times seriously compromised. For example, the wheels in a modified vehicle must be larger. This makes the vehicle taller. Additionally, the distance between wheels on one axle is decreased. These two factors in combination foster a greater likelihood of the vehicle tipping in turns upon surface roads. Also, the turning radius is increased, thus seriously jeopardizing the vehicle maneuverability in evasive or emergency situations.

What is needed is an apparatus to allow motor vehicles to traverse rail lines without incurring the potentially unsafe and permanent modifications currently required. This can be accomplished by providing a carrier which can both ride the rails while supporting the motor vehicle, and also travel upon roadways by towing by the motor vehicle. This allows full use of vehicle and a longer lasting apparatus for rail inspection and/or repair. It is to this continuing need of the railroad industry that the present invention is directed.

SUMMARY OF THE INVENTION

The present invention is an apparatus which functions like a trailer, attachable to the rear of a motor vehicle. The carrier is capable of supporting the weight of the vehicle thereon. The apparatus of the present invention facilitates movement of a motor vehicle upon railways, the apparatus being capable of transit upon roadways by towing by the motor vehicle, the motor vehicle having a first set of wheels and a second set of wheels deployed thereon at a determined distance from the first set of wheels, the apparatus being capable of supporting the motor vehicle thereupon, the apparatus comprising:

- a platform upon which the motor vehicle may be mounted;
- a first set of train wheels attached to the platform;
- a second set of train wheels attached to the platform;
- adjustable means for engaging the roadway, the adjustable means enabling the apparatus to travel upon roadways when deployed in an extended condition, or to allow travel upon railways by the first and second sets of train wheels when deployed in a retracted condition;
- means for receiving a rotational energy from one set of wheels of the motor vehicle; and
- means for transmitting the rotational energy from the means for receiving to one of the sets of train wheels.

The apparatus may further comprise means for securing the motor vehicle upon the platform of the apparatus.

The apparatus of the present invention may further comprise a ramp releasably attachable to the platform, and even further comprise means for carrying the ramp, the means for carrying being formed on the platform.

The apparatus of the present invention may further comprise a platform that comprises a first portion and a second portion, wherein the second portion has formed integrally thereto an extending portion that telescopes into the first portion and supports the first portion. The apparatus may still further comprise means for releasably securing the first portion and the second portion of the platform. In a preferred embodiment, the means for securing may comprise slots formed in the extending portion, an inner plate, an outer plate and a plurality of bolts disposed through the inner plate, the slots of the extending portion, and the outer plate.

It is envisioned that the apparatus may have for the adjustable means for engaging the roadway an embodiment that comprises:

a plurality of road wheels;

a first arm upon which at least one of the road wheels is rotatively mounted;

a second arm upon which at least one of the road wheels is rotatively mounted; and means for deploying the road wheels in either the extended position or in the retracted position.

Within this particular embodiment of the adjustable means for engaging, it is foreseen that a particular embodiment of the means for deploying may comprise:

a stability rail mounted to the platform;

a guide rail mounted to the platform adjacent to the stability rail, the guide rail having a threading disposed thereon;

a first collar, the first collar being disposed around the stability rail and the guide rail, the first collar having a threading formed therein such that the threadings of the first collar and the guide rail are interdigitated;

a first brace attached to the first arm;

a first clevis pivotally connecting the first brace and the first collar;

a second collar, the second collar being disposed around the stability rail and the guide rail, the second collar having a threading formed therein such that the threadings of the second collar and the guide rail are interdigitated;

a second brace attached to the second arm;

a second clevis pivotally connecting the second brace and the second collar; and a crank comprising a handle and a shaft, the handle and the shaft being formed together substantially normal, the shaft being attached to the guide rail;

wherein the crank may be turned, thereby rotating the guide rail, the rotation of the guide rail moving the first and second collars thereon, the movement of the collars effecting either the extension or the retraction of the arms and thus the deployment of the road wheels attached thereto.

The apparatus may further comprise a plurality of jacks mounted to the platform.

The apparatus is envisioned, as a particular embodiment of the means for receiving, to comprise:

a first axle deployed on the platform;

a second axle deployed on the platform, the second axle being connected with the means for transmitting;

a first roller comprising:

a first cylindrical member rotatively mounted upon the first axle;

a second cylindrical member rotatively mounted upon the second axle; and a track disposed around the first cylindrical member and the second cylindrical member;

a second roller comprising:

a first cylindrical member rotatively mounted upon the first axle;

a second cylindrical member rotatively mounted upon the second axle; and a track circumferentially disposed around the first cylindrical member and the second cylindrical member;

wherein either the front set of wheels or the rear set of wheels of the motor vehicle are positioned upon the first roller and second roller, such that the motor vehicle may be run and the wheels allowed to rotate upon the rollers, the rotational energy generated by the wheels of the motor vehicle being received by the tracks of the rollers, causing the cylindrical members of the rollers to rotate, in turn causing the axles thereof to turn and receive the rotational energy, thereby imparting said rotational energy to the means for transmitting.

In a second embodiment of the present invention, means for transmitting of the present invention may particularly comprises a continuously variable transmission connected to receive rotational energy from the second axle and relay said rotational energy to one of the sets of train wheels.

The present invention is envisioned, in all embodiments, as comprising means for braking the rail wheels. Further, all embodiments of the present invention are envisioned as having means for braking the road wheels. Finally, each embodiment of the apparatus of the present invention is foreseen to have means for alternately engaging the means for braking the rail wheels or the means for braking the road wheels.

A third embodiment of the apparatus of the present invention is seen to comprise all the basic elements of the first embodiment, to wit:

a platform having a forward end and a rearward end from which the motor vehicle may be mounted thereon;

a first set of train wheels attached to the platform;

a second set of train wheels attached to the platform;

adjustable means for engaging the roadway, the adjustable means enabling the apparatus to travel upon roadways when deployed in an extended condition, or to allow travel upon railways by the first and second sets of train wheels when deployed in a retracted condition;

a first means for receiving a rotational energy from the first set of wheels of the motor vehicle; and a first means for transmitting the rotational energy from the first means for receiving to the first set of train wheels.

Additionally, the third embodiment is seen to further comprise a second means for receiving a rotational energy from the second set of wheels of the motor vehicle, the second means for receiving being deployed from the first means for receiving at a certain distance, the certain distance being substantially equal to the determined distance between the first set of wheels and the second set of wheels of the motor vehicle, and a second means for transmitting the rotational energy from the second means for receiving to the second set of train wheels. This third embodiment allows the present invention to accommodate vehicles that have four-wheel drive capabilities, and thus put that additional power to work in the apparatus.

It is understood that the first means for receiving and the second means for receiving will be set at a certain distance from each other. The certain distance will be substantially the same as the distance between the two wheel axles of the motor vehicle. However, the distance between the first set of wheels on a motor vehicle and the second set of wheels is not standard between different makes and models of vehicles. Accordingly, the third embodiment of the present invention would include all that comprises the second embodiment of the apparatus, and then further comprise means for altering the certain distance between the first means for receiving and the second means for receiving.

The present invention will be more clearly understood by the following detailed description, with reference being made to the accompanying drawings, in which like reference numerals refer to like parts, in which:

DETAILED DESCRIPTION OF THE DRAWINGS

Figure 2:
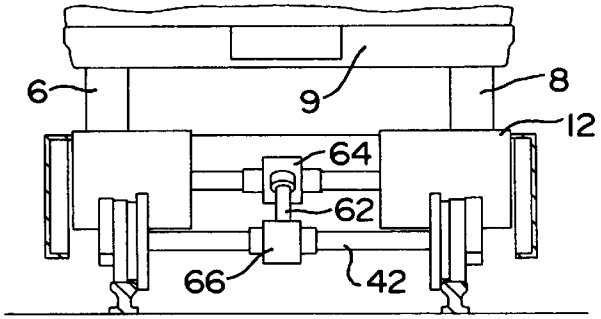
FIG. 2 is a cross-sectional rear view of the first embodiment of the present invention with a motor vehicle mounted thereon.

Referring now to FIGS. 1–5, there is shown therein the present invention, to wit, an apparatus 10 capable of traveling upon roadways when towed by a motor vehicle 2 or capable of traveling upon railways with the motor vehicle 2 mounted thereupon. The apparatus 10 comprises a platform 12, means 20 for hitching the apparatus 10 to the motor vehicle 2, means 30 for securing the motor vehicle 2 upon the apparatus 10, a ramp 14 releasably attachable to the platform 12, means 90 for stabilizing the position of the apparatus 10 during mounting of the motor vehicle 2, a first truck 40 of train wheels, a second truck 41 of train wheels, means 50 for receiving a rotational energy deployed in the platform 12, means 60 for transmitting rotational energy, a plurality of road wheels 70, 71 and adjustable means 80 for engaging the roadway.

Figure 1:
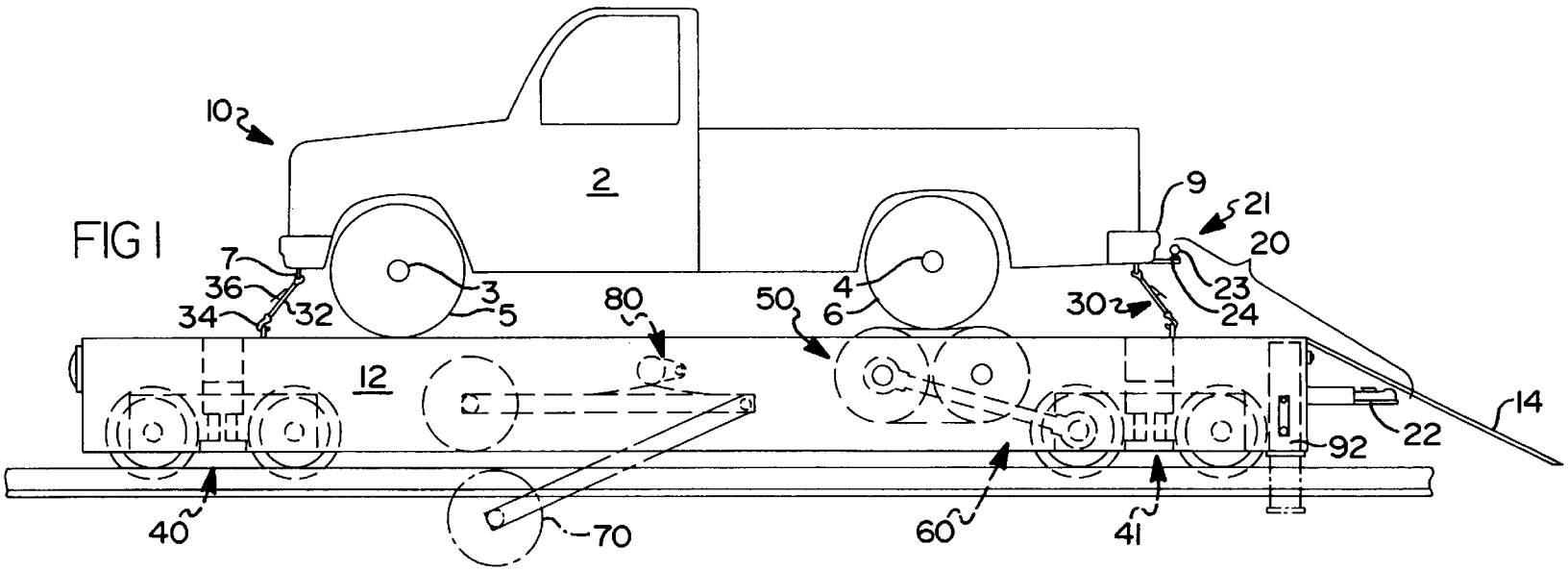
FIG. 1 is a side view of a motor vehicle mounted upon a first embodiment of the present invention, with components of the present invention shown in shadow.

The motor vehicle 2, as shown in FIG. 1, is a pick-up truck. Such a motor vehicle 2 is commonly expected to be used in conjunction with the apparatus 10. Trucks currently operate in the industry, in modified form, to travel the rails for inspection and repair duty. Examples of these can be found in the literature of the Fairmont Tamper series of modified vehicles. The pick-up truck is well-suited to the storage requirements related to the inspection and repair tasks, including the hauling of tools, other equipment, timbers, and the like. However, the apparatus 10 is capable of accommodating other four-wheeled motor vehicles thereupon, most notably the automobile or the sport utility vehicle (SUV). It is even conceivable that three-wheeled vehicles could be used to power the apparatus 10; the most likely candidate for this task would be an all-terrain vehicle (ATV). The usual mode of operation for the present invention is envisioned to be with a four-wheeled motor vehicle, by virtue of the power afforded by its engine for both driving the apparatus 10 upon the railways and for towing the apparatus 10 upon the roadways.

The motor vehicle 2, as depicted in FIG. 1, has a first or front axle 3 and a second or rear axle 4. The first axle 3 has at least two wheels mounted thereon, forming a first set of wheels, an exemplary wheel of the driver's side of the vehicle being indicated at 5. Likewise, the second axle 4 has at least two wheels mounted thereon, forming a second set of wheels, indicated at 6 and 8 respectively in FIGS. 1 and 2. The motor vehicle 2 may be operated when mounted upon the apparatus 10, such that either the first axle 3 of wheels or the second axle 4 of wheels may rotate, depending upon which axle is the drive axle for the motor vehicle 2. It is presumed in the first embodiment of the present invention that the motor vehicle 2 is a single-axle, rear-wheel driven vehicle. One of the subsequent embodiments of the present invention will address the mounting of a motor vehicle with dual-axle drive capabilities, commonly known as four-wheel drive vehicles.

When mounted upon the apparatus 10, as shown particularly in FIG. 1, the motor vehicle 2 is positioned and held fast thereon by means 30 for securing the motor vehicle 2 upon the apparatus 10. The preferred embodiment of the means 30 for securing comprises a plurality of devices commonly known as "come-a-longs". These devices comprise a nylon strap 32 normally, although any suitable sturdy material could be alternately selected. The strap 32 is connected to the body of the motor vehicle 2, as shown in FIG. 1, by wrapping the strap 32 around a rod 7 attached thereto the vehicle 2, and to the platform 12 of the apparatus 10 by a closed hook 34, formed to the strap 32, which is lockingly engaged to an eyelet bolt anchored to the platform 12. Any slack in the strap 32 is removed by the tightening thereof by a winch 36 deployed thereon the strap 32. Although it may be possible to secure the motor vehicle 2 using only two come-a-longs, as shown in FIG. 1, the present invention envisions four come-a-longs deployed one at each corner of the motor vehicle 2.

Figure 7:
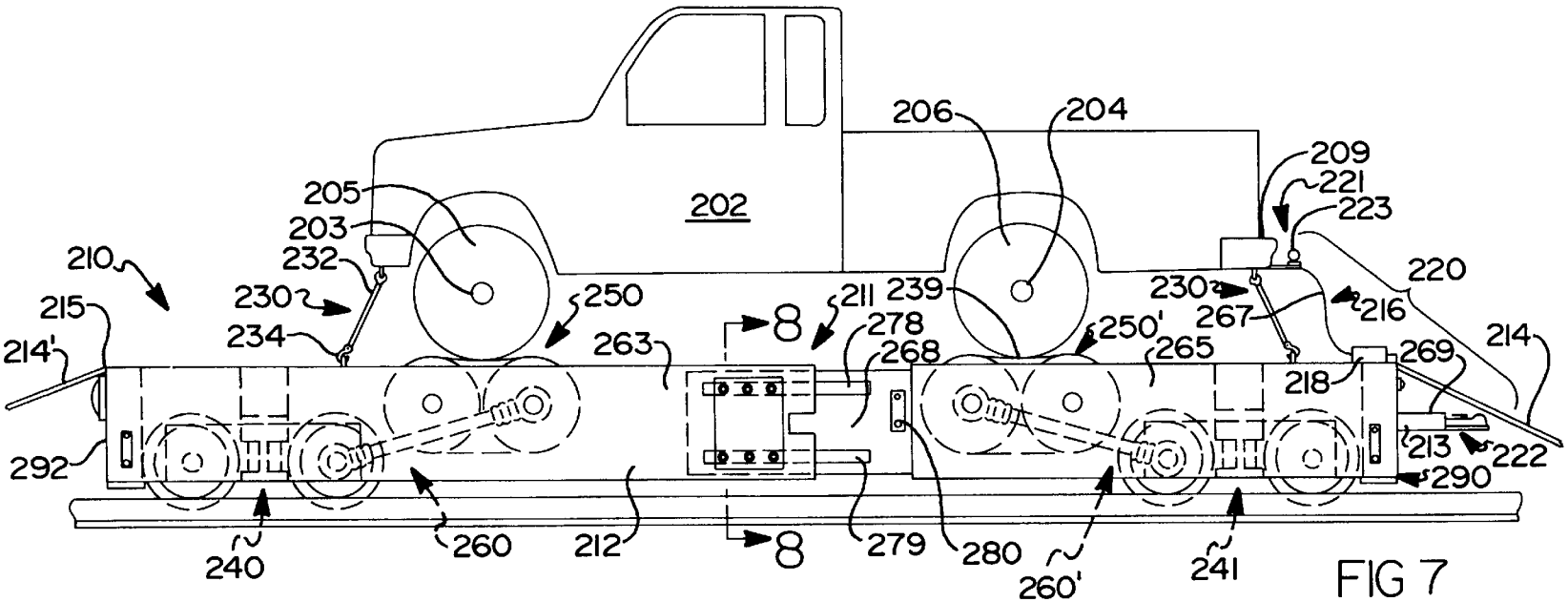
FIG. 7 is a side view of a third embodiment of the present invention.

An alternate embodiment of the means for securing is shown in FIG. 7. The secondary embodiment of the means 230 for securing comprises a chain 232 connected at one end to the motor vehicle 202, and at the other end to the platform 212 by a closed hook 234 to an eyelet bolt. While only two embodiments of the means for securing have been set forth, these embodiments are given by way of example, and are not meant to restrict the present invention from embracing any other known and suitable means for securing known to the skilled practitioner in the art, particularly in the towing arts for vehicles, whereupon vehicles are mounted upon flatbeds.

Referring again to FIGS. 1–5, there is seen means 20 for hitching comprising a forward component 21 and a rearward component 22. The forward component 21 comprises a hitch ball 23 and a mounting frame 24. The mounting frame 24 is attached to the bumper 9 of the motor vehicle 2. The hitch ball 23 is correspondingly formed to the mounting frame 24. The rear component 22 is attached to the apparatus 10. The rear component 22 fits over and attaches to the hitch ball 23 of the forward component 21. This allows for the towing of the apparatus 10 by the motor vehicle 2 upon roadways. One known example of this type of hitching means is found in U.S. Pat. No. 3,881,577, issued to Wherry et alia, the contents of which are incorporated herein by reference. The means 20 for hitching are also intimately connected with means for braking the road wheels, as will be set forth in detail herein below.

The ramp 14, as shown in FIG. 1, is a single piece, substantially equal in width to the platform 12. Ideally, the ramp 14 is formed of a high-strength steel or other metallic compound or alloy sufficient to bear the weight of the motor vehicle 2 as it mounts the platform 12 of the apparatus 10. Alternately, the ramp 14 could comprise two pieces, each capable of accommodating the wheels of one side, whether the driver or the passenger, of the motor vehicle 2. This alternate embodiment of the ramp 14 would be similar to that used in vehicle carriers.

The ramp 14 is releasably attachable to the apparatus 10, being mounted at either end of the platform 12. The platform 12 and ramp 14 may intermesh, such as in a tongue and groove arrangement. Alternately, the ramp 14 could be held within the platform 12 and pulled out therefrom in a telescoping manner. One embodiment of this concept, seen in use with a truck, is found in U.S. Pat. No. 5,257,894, issued to Grant, the contents of which are incorporated herein by reference.

Means 90 for stabilizing the platform 12 serves the purpose of preventing the apparatus 10 from moving while the motor vehicle 2 mounts, dismounts, hitches to, or unhitches from the apparatus 10, particularly by the lifting one end thereof off the ground. This is accomplished, in the preferred embodiment, by the attachment of a plurality of jacks 92 to the platform 12. By turning a crank 94, the lower portion 96 of the jack 92 is brought into contact with the ground. Each jack 92 is of necessity mounted proximate to one end of the platform 12 to which the ramp 14 is attached. The purpose of the means 90 for stabilizing is to prevent the end of the platform 12 proximate the ramp 14 to not be pulled down, and correspondingly to not raise up the opposite end of the platform 12, when the motor vehicle 2 attempts to mount or dismount the apparatus 10 by driving up or down, respectively, the ramp 14 and onto or off of the platform 12.

As an alternate means 90 for stabilizing, the end of the platform 12 opposite to which the ramp 14 is mounted can be secured to the railway by means of a pair of C-shaped members. The C-shaped members would slide under the rails and also engage the apparatus 10. Alternately, other securing means, such as steel reinforce chains, can be used to tie the opposite end of the platform to the railway.

The apparatus 10 has a first truck 40 and a second truck 41 of train wheels mounted thereto. The trucks 40, 41 are substantially similar to those utilized on box cars or other rail vehicles. One example of a type of train wheel suitable for use in the present invention is found in U.S. Pat. No. 4,307,910 issued to Rodney, the contents of which are incorporated herein by reference. As set forth in Rodney, each railroad car has two trucks, also referred to as bogeys. Each truck has two sets of wheels, each set of wheels having an axle assembly. Rodney teaches the construction of lightweight yet sturdy railway wheels and axles. It is seen as preferable to reduce the weight of the apparatus 10 while not sacrificing strength, since the weight of the vehicle 2 which can be deployed upon the platform 12 is always within a known set of values, said weight being substantially less than that which the normal railway wheel is subject to on a typical boxcar.

Other embodiments of railway wheels are known and suitable in the present invention. Three additional examples are seen in U.S. Pat. No. 2,768,020 issued to Sylvester; U.S. Pat. No. 3,960,400 issued to Licht et alia; and U.S. Pat. No. 5,333,926 issued to Christie et alia, the contents of all three patents incorporated herein by reference.

The first truck 40 comprises a first axle 42 having one wheel mounted at each end thereof, and a second axle 44 having one wheel mounted at each end thereof. A truck bolster 46 is deployed between the axles 42, 44. A center plate 48, which allows a defined radius of turning within the truck 40 is centrally deployed in the truck bolster 46. It is envisioned that both truck 40, 41 contain a center plate 48 to allow either end of the platform 12 to be capable of turning, and thus acting as the front of the apparatus 10.

The second truck 41 comprises a first axle 43 having one wheel mounted at each end thereof, and a second axle 45 having one wheel mounted at each end thereof. A truck bolster 47 is mounted between the axles 43, 45 of the truck 41.

Figure 3:
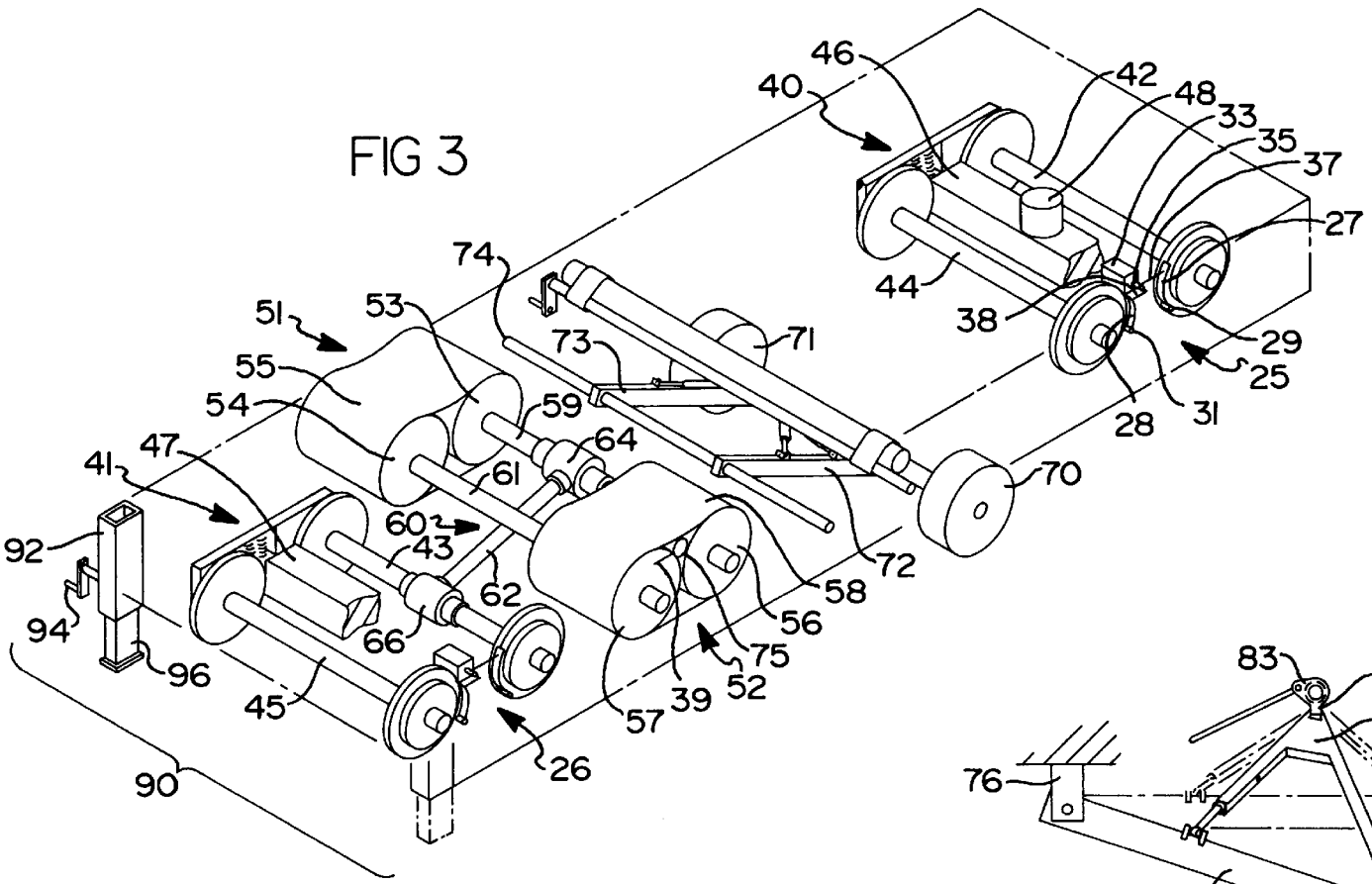
FIG. 3 is a perspective view of the first embodiment of the present invention, with the interior components visible.

As shown in FIG. 3, each truck or bogie 40, 41 of train wheels has at least one set of train brakes 25, 26. Since the train brakes are identical, only the first set 25 will be described in detail, with the explanation being understood as applicable to the second set 26. The brakes 25 comprise a pair of brake pads 27, 28, one pad given to one wheel of different axles. The pads 27, 28 are each anchored at pins 29, 31. Upon an activation signal, an electrical motor 33 is worked to turn a shaft 35 and thereby through an intermediate member extends two arms 37, 38 attached thereto and to the brake pads 27, 28. By this action, the pads 27, 28 are applied to the wheels.

An alternate arrangement, set forth for a handbrake on a freight car but similar in function, is found in U.S. Pat. No. 4,346,790 issued to Morrison et alia and incorporated herein by reference. Also, a type of railway brakes is taught in U.S. Pat. No. 3,791,491 issued to Tickle, which is hereby incorporated by reference.

Once the motor vehicle 2 is set upon the platform 12 and secured thereupon by the means 30 for securing, the means 90 for stabilizing are disengaged. The drive axle of the motor vehicle 2, herein presumed and shown to be the rear axle 4, are positioned on means 50 for receiving rotational energy. The means 50 for receiving rotational energy comprise, in the preferred embodiment, a first set 51 of rollers and a second set 52 of rollers. The sets 51, 52 of rollers each comprise a first cylindrical member, 53, 56 respectively, a second cylindrical member 54, 57 respectively, and an outer casing or tread, 55, 58 respectively. Both the first cylindrical members 53, 56 and second cylindrical members 54, 57 are formed of steel or, alternately, of any other durable material capable of being driven at high speeds by a motor vehicle 2. The treads 55, 58 are formed of a highly durable yet flexible material, such as a polymer or a rubber-based compound. The treads 55, 58 are deployed around the first cylindrical members 53, 56 and second cylindrical members 54, 57 in each set 51, 52 of rollers.

A first axle 59 and a second axle 61 are deployed in the platform 12. The first cylindrical members 53, 56 of the first set 51 of rollers and the second set 52 of rollers are coaxially mounted on the first axle 59. Correspondingly, the second cylindrical members 54, 57 of the first set 51 of rollers and the second set 52 of rollers are coaxially deployed upon the second axle 61.

The drive wheels of the vehicle 2, again herein shown as the rear axle 4 of the motor vehicle 2, turn when the motor vehicle 2 is first secured by the means 30 for securing onto the platform 12 and, secondly, the engine of the motor vehicle 2 is started and put into gear. The rotation of the wheels 6, 8 of the drive axle 4 effect the movement of the treads 55, 58. The treads 55, 58 in turn rotate the cylindrical members 53, 54, 56, 57, which in turn drive the axles 59, 61. In this manner is a rotational energy, generated by the drive wheels 6, 8 of the motor vehicle 2 received by the apparatus 10.

It is to be understood that some alteration in the method set forth for the means 50 for receiving a rotational energy are considered to be within the scope of this invention. One variation is to eliminate the treads 55, 58, such that the drive wheels 6, 8 of the motor vehicle 2 directly contact the cylindrical members 53, 54, 56, 57 of the first set 51 and second set 52 of rollers. While this is less preferred, as it will hasten the deterioration of the cylindrical members 53, 54, 56, 57, and said cylindrical members 53, 54, 56, 57 are significantly more difficult to replace than the treads 55, 58, this is an alternate way of implementing the means 50 for receiving a rotational energy. Further, lack of a tread 55, 58 will cause dramatic deterioration of the wheels of the motor vehicle 2.

Another alteration conceived for the means 50 of receiving a rotational energy would be to replace the first and second cylindrical members 53, 54, 56, 57 of each set 51, 52 of rollers with an elongated cylindrical member that is substantially the length of the first axle 59 or the second axle 61 respectively. In such an alternate embodiment, this will necessarily dictate the location of any means for transmitting off to the side of the first axle 59 and second axle 61, similar to FIG. 6, as will be described herein further below in relation to the second embodiment of the present invention.

It is also desired, when mounting the motor vehicle 2 upon the platform 12, to prevent the means 50 for receiving from moving as the motor vehicle 2 is driven thereover the treads 55, 58. Accordingly, an emergency brake 39 is deployed on the platform 12. The emergency brake 39 comprises an element 75 inserted between the cylindrical members 56, 57. The turning of a crank advances a mechanism (not shown) which extends the element 75 between the cylindrical members 56, 57. The pressing of a release switch on the mechanism allows the crank to be turned in the opposite rotation, and thus the element 75 is retracted from between the cylindrical members 56, 57 to allow rotation thereof once the vehicles is deployed upon the platform 12. It is to be noted that if multiple means 50 for receiving are deployed upon the platform 12, as in the third embodiment herein further below, then at least one emergency brake 39 must be deployed in each means 50 for receiving.

Means for transmitting a rotational energy, shown in FIGS. 1 and 3 at 60, is connected to the first axle 59 of the means 50 for receiving, and to one of the train wheel axles 43 of the first truck 41. As shown, the means 60 for transmitting comprises a direct drive differential transmission, comprising a drive shaft 62, a differential 64 and a differential 66. Transmissions of this type are well known in the motor vehicle arts, and an extended discussion of the various types will not be given herein. Two sources explaining the requirement and types of transmissions are *The Motor Vehicle* (11th Edition) by K. Newton, W. Steeds and T. K. Garrett, and *Mechanical Power Transmission Components*, edited by D. South and J. Mancuso, both of which are incorporated herein by reference.

It is seen in FIGS. 1–5 that roads wheels 70, 71 are connected to arms 72, 73, said arms 72, 73 being connected thereto the platform 12 by a shaft 74 pivotally mounted thereon at bracket 76. The wheels 70, 71 are standard inflatable tires, similar to those used on trailers and which are well known and commonly available. The arms 72. 73 are steel members, or formed of an otherwise suitable and sturdy material. The shaft 74, likewise, is a steel formed member, as are its coupling members, one shown exemplary at 76.

Means 80 for engaging the road wheels 70, 71 comprises, in the preferred embodiment, a stability rail 81, a guide rail 82, a first collar 83, a first brace 84 and a first clevis 85, a second collar 86, a second brace 87 and a second clevis, and a crank 89.

The stability rail 81 is a cylindrical member mounted underneath the platform 12. The stability rail 81 is formed of a suitable metallic alloy to endure the stresses and wear that this member will be subject to. Of importance is the cylindrical nature of the rail 81, such that the collars 83, 86 may slide therealong, as explained herein further below. While an alternate cross-sectional shape, such as triangular, quadrangular or hexagonal, for example, could be elected for the cross-sectional shape of the stability rail 81, it is seen as preferred to elect a substantially circular, or alternately elliptical, cross-section for this rail 81.

The guide rail 82 is a cylindrical member of circular cross-section. The guide rail 82 is connected to the stability rail 81 at approximately its center point by a joint 78. The guide rail 82 has formed thereon at least one threading. In the preferred application, the guide rail 82 has formed thereon two threadings, one of which is deployed in a counter-clockwise orientation, and the other being deployed in a clockwise orientation. Attached to one end of the steel or otherwise metallic alloy formed guide rail 82 is a crank 89, which comprises a blade 98 and a handle 99.

A first collar 83 and a second collar 86 are identically formed and deployed circumferentially around the stability rail 81, and circumferentially and interdigitatively around the guide rail 82. The collars 83, 86 are formed of a suitably tear-drop or pear shape. A large or first bore is formed in the larger or bottom portion of the collars 83, 86 to allow each collar 83, 86 to be slidingly disposed around the stability rail 81. Thus, the circumference of the outer surface of the stability rail 81 and the inner surface of the first bore of the collars 83, 86 are substantially equal.

The narrower or top portions of the collars 83, 86 have a second bore formed therein. This second bore is formed with a threading cut therein to that is compatible with the threading or threadings formed on the guide rail 82, such that the threadings can interdigitate and engagingly mesh. Of necessity, the circumference of the second bore of the collars 83, 86 needs to be substantially similar to the circumference of the guide rail 82.

The dual deployment of the collars 83, 86 upon the stability rail 81 and the guide rail 82 allows for a controlled movement of the collars 83, 86 in response to rotation of the guide rail 82. Thus, the turning of the crank 89 in either a clockwise or a counter-clockwise motion will cause a similar rotation in the guide rail 82. This rotation causes the threading of the guide rail 82 to affect the location of the collar 83, 86 because of the interdigitation of the threadings of the collars 83, 86 with those of the guide rail 82. Further, since one half on the guide rail 82 has threading in one orientation, upon which one collar rides, and the second half of the threadings of the guide rail 82 is in the opposite direction and upon which the other collar rides, the rotation of the guide rail 82 will cause the collars 83, 86 to either move closer together or further from each other. This coordinated movement of the collars 83, 86 is critical to the operation of the means 80 for engaging, as will be further understood herein below.

The first brace 84 is connected to the first collar 83 by the first clevis 85. The second brace 87 is connected to the second collar 86 by the second clevis, which is identical to the first clevis 85. Each brace 84, 87 and each clevis 85 is formed of a suitably strong metallic alloy. The braces 84, 87 are substantially V-shaped, with the associated devises being joined thereto the braces 84, 87 at the joint of the arms of the V-shaped braces 84, 87. The clevis 85 is welded to its respective collar 83, and similarly is the corresponding clevis welded to the collar 86. The clevis 85 is hingedly connected to its respective brace 84, and correspondingly the clevis welded to collar 86 is hingedly connected to its respective brace 87.

The braces 84, 87 have disposed in each arm thereof a telescoping member 91, 93, 95, 97, each of which is attached to one of the arms 72 or 73 in a hinged manner. It is conceivable that the telescoping members 91, 93, 95, 97 could be formed as shock absorbers, as commonly known. However, what is critical is that the telescoping members 91, 93, 95, 97 facilitate the movement of the arms 72, 73 in relation to the movement of the collars 83, 86.

The means 80 for engaging the road wheels operates by first turning the crank 89 to effect movement of the collars 83, 86 by rotating the guide rail 82. The collars 83, 86 effect by their movement the pulling or the pushing of the braces 84, 87. By this pushing or pulling the arms 72, 73 are either extended or retracted. Accordingly, the road wheels 70, 71 are either deployed or retracted. This action will effect the lowering of the apparatus 10 onto a railway, such as at a crossing, or effect a raising therefrom.

It is understood that more than one wheel may be attached to each arm 72, 73, as desired. What is shown is that at least one wheel is attached to each arm 72, 73, which is the minimum necessary.

Figure 4:
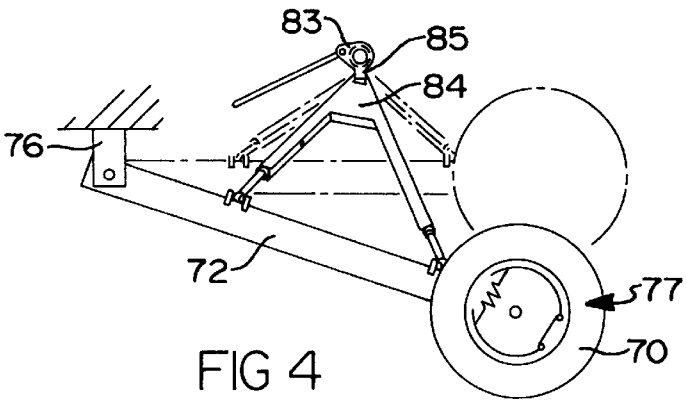
FIG. 4 is a side view of the first embodiment of the means for deploying the road wheels of the present invention.

It is to be further understood that the roadwheels 70, 71 will have formed therewith means 77 for braking, as seen in FIG. 4. Such means for trailers are well known in the art, and such similar means are intended for use herewith the present invention. Some examples of such braking systems are found in the following U.S. Pat. No. 3,881,577 issued to Wherry et alia; U.S. Pat. No. 4,084,859 issued to Bull et alia; U.S. Pat. No. 4,099,790 issued to Hipps; U.S. Pat. No. 4,163,586 issued to Snyder; U.S. Pat. No. 4,295,687 issued to Becker et alia; U.S. Pat. No. 5,295,736 issued to Brearley; the contents of these patents being hereby incorporated by reference.

Figure 6:
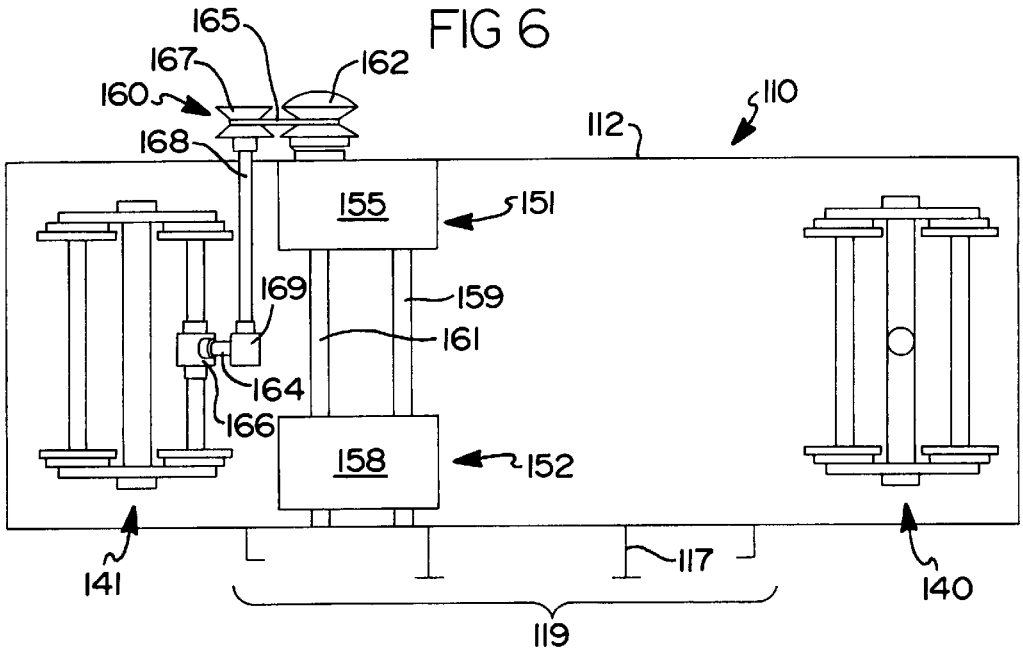
FIG. 6 is a top view of a second embodiment of the present invention.
Figure 5:
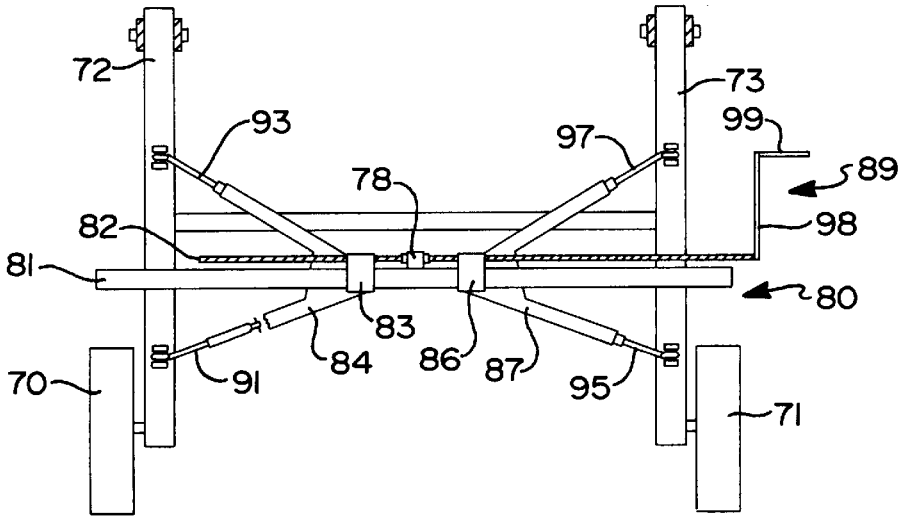
FIG. 5 is a top view of the first embodiment of the means for deploying the road wheels of the present invention.

In reference to a second embodiment of the present invention, shown in FIG. 6 at 110, it can be seen that an alternate embodiment of the means 160 for transmitting rotational energy may comprise a continuously variable transmission (CVT). The CVT comprises a centrifugal clutch 162 which receives the rotational energy from the second axle 161 of the rollers 151, 152. This is transmitted by a belt 165 to a driven pulley 167, which turns a shaft 168 connected to a differential 169, which turns shaft 164, which is connected to the axle of the second bogey 141 by a differential 166. This can effect a smoother shifting when speeds are unevenly increased or decreased upon the railways. Also, it can allow for the deployment of cylindrical members whose tread span the width of the platform 112.

There is further seen means 119 for carrying a ramp formed thereto the platform 112. As shown, the means 119 for holding comprises a plurality of L-shaped brackets 117 attached releasably to the side of the platform 112. This presumes an alternate embodiment of ramps of the type with two slot-type panels, one for each side of the vehicle's wheels, and not for a single piece member. It is conceivable that the means for holding could alternately comprise one or more inlaid recesses on the top of the platform 112. Thus, either a single piece or a dual piece ramp can be accommodated. In all other aspects, the second embodiment is substantially similar to the first embodiment, including a first bogey 140 opposite the second bogey 141 to parallel the first truck 20 and second truck 41 of the first embodiment, treads 155 and 158 on the rollers 151 and 152 respectively, and a first axle 159 and a second axle 161 on each of the rollers 151 and 152 respectively.

Figure 8:
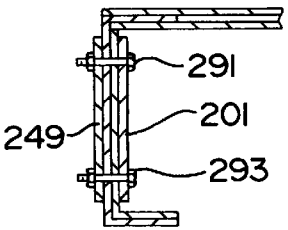
FIG. 8 is a cross-sectional view of the platform taken along line 8—8 of the present invention.

Referring now to FIGS. 7 and 8, there is shown therein a third embodiment of the present invention 210. The general formation of this embodiment will follow that of the first embodiment for all items not specifically addressed herein below.

The platform 212 has the capability of receiving the ramp 214 or 214' at either end thereof, as indicated at 213 and 215 respectively. In all other aspects, the ramps 214, 214' and its engagements to the platform 212 are substantially similar to the first embodiment.

Means 216 for alternately engaging the means for braking the rail wheels or the road wheels of apparatus 210 is shown by box 218 connected to both the motor vehicle 202 by the forward component 221 and to the apparatus 210 by the rearward component 222 of the means 220 for hitching. The means 216 for alternately engaging is envisioned to be built directly into the means 220 for hitching, as is known and practiced currently in the motor vehicle industry, particularly the pick-up truck segment thereof mounted proximate the bumper 209. However, when the means 220 for hitching are not connected, such as when the motor vehicle 202 is mounted upon the platform 212, alternate connections must be made from the motor vehicle 202 to the platform 212 to effect engagement of the railway brakes. This is accomplished through the use of the box 218 and the connecting lines 267, 269. The box 218 is a connection juncture for the wires 267, 269, although a more involved embodiment could allow for means for determining of signals, to allow for one set of lead wires to let different signals be transmitted therefrom to engaged one or the other braking systems.

One embodiment of this means 216 for alternately engaging could be a direct coupling from the motor vehicle 202 to the means 220 for hitching or the box 218 that will engage the brakes for both roadwheels and railwheels whenever the brakes of the motor vehicle are engaged. More preferably, however, there would be provided on the platform 212 two receiving slots or plugs. One such slot or plug would be in the means for hitching, and this would engage the brakes of the road wheels. The second plug would be in the platform 212 to engage the brakes on the railway trucks 240, 241. It should be noted that both trucks 240, 241 are capable of turning, and thus contain a center plate to facilitate said turning. This allows the apparatus 210 to travel with either end 213, 215 serving as the front of the platform 212.

It is noted that the third embodiment has two means for receiving a rotational energy formed therein, referenced as 250 and 250'. Each of these means 250, 250' are identical to the means 50 for receiving of the preferred embodiment. The use of two means 250, 250' for receiving is to facilitate a dual-axle drive vehicle 202 upon the apparatus 210. This can generate more power and also more control over the railway travel of the apparatus 210. Each means 250, 250' for receiving is in communication with a respective means 260, 260' for transmitting.

An alternate embodiment of the emergency brake is shown at 239. The emergency brake of the third embodiment comprises a long metalic piece that is fit into the means 250' for receiving between the tread thereof and the top of the platform 212. This effects the stopage of rotation of the tread, and thus the cylindrical members, of the means 250' while the motor vehicle 202 is being mounted upon the apparatus 210.

One additional concern addressed by the third embodiment of the present invention is the fact that each motor vehicle 202 has its own distinct offset distance between the forward axle 203 and the rearward axle 204 thereof with exemplary wheels 205 and 206 mounted thereon respectively. Accordingly, the third embodiment of the apparatus 210 includes means 211 for altering the distance between the first set of rollers and the second set of rollers thereof. The means 211 for altering comprises a way to extend or contract the length of the platform 212 at the center thereof.

The platform 212 of this third embodiment is not, as in the previous embodiments, a single piece. Rather, the platform 212 comprises a first portion 263 having the first means 250 for receiving deployed therein, and a second portion 265 having the second means 250' for receiving deployed therein. The second portion 265 of the platform 212 has an extending portion 268 integral thereto that telescopes into and supports thereon the first portion 263 of the platform 212.

As seen in FIGS. 7 and 8, the second portion 268 has two parallel slots 278, 279 cut therein. Once the deployment length of the two means 250, 250' for receiving is set corresponding to the offset length of the axles 203, 204 of the motor vehicle 202, an outer plate 249 of steel and an inner plate 201 of steel are deployed adjacent to the two slots 278, 279. Bolts 291, 293 are inserted through the plates 249, 201 and the slots 278, 279, and then tightened. By this, a secure engagement is effected and the platform 212 is secure. Further, the two portions 263, 265 may be realigned by loosening the bolts 291, 293 and readjusting the distance between the two means 250, 250' for receiving. It is to be understood that the combination of the slots 278, 279, the bolts 291, 293, the inner plate 201 and the outer plate 249 combine to comprise means for securing the first portion 263 and the second portion 265 of the platform 210.

It is to be understood that the means 211 for altering, which is shown as part of the third embodiment of the present invention, is not intended to be limited only to that embodiment. Further, although the mean 211 are well disposed for use in conjunction with the deployment of a plurality of means 250, 250' for receiving, it is to be expressly understood that the two different means can be used one without the other. Most particularly, although the means 211 for altering has been used in the third embodiment, it can also be used in conjunction with the first embodiment of the present invention. Thus, although only one means 50 for receiving is used in the first embodiment of the apparatus 10, a corresponding means 211 can be used in the apparatus 10 to allow vehicles of different, and especially longer, lengths to be accommodated thereon. The third embodiment 210 of the present invention is also understood to comprise adjustable means 280 to engage the roadway, means 290 for stabilizing the platform, which includes a plurality of jacks 292, similar to the first embodiment of the present invention.

In use, and with reference generally herein to the primary embodiment, the apparatus 10 is hitched to the motor vehicle 2 by the means 20 for hitching. The road wheels 70, 71 of the apparatus 10 are in the extended position, such that the road wheels 70, 71 contact the road and the sets 40, 41 of train wheels are positioned above the ground. The ramp 14 to the apparatus 10 is stored, ideally, in the means for carrying. The means for alternately engaging the roadwheel brakes are connected, here through the means 20 for hitching, as is commonly understood and known.

Upon arriving at the desired intersection of roadway and railway, the apparatus 10 is positioned over the railway for proper mounting thereon. The forward component 21 of the means 20 for hitching is disengaged from the rearward component 22, after the means for stabilizing have been deployed. The means for engaging the brakes is disconnected. The roadwheels 70, 71 are retracted, and in the process the platform 12 and the attached trucks 40, 41 of train wheels are thereby lowered, the train wheels engaging the railway.

Once upon the railway, with the means 90 for stabilizing the apparatus 10 still engaged, and possibly adjusted, this being in the preferred embodiment by the extension of the plurality of jacks 92 attached to the platform 12. The ramp 14 is then attached to one end of the platform 12. The emergency brake 39 is engaged into one of the rollers, to prevent turning by the cylindrical members while the motor vehicle 2 is mounted onto the platform 12. After the motor vehicle 2 is mounted upon the platform 12, the motor vehicle 2 is secured thereupon by come-a-longs or other suitable means 30 for securing. The means for engaging the train brakes 25, 26 is connected to the motor vehicle 2. The emergency brake 39 is disengaged, and the motor vehicle 2 is started and set into gear.

The rotation of the wheels 6, 8 of the drive axle 4 drive the treads 55, 58 of the sets 51, 52 of rollers. The turning of the cylindrical members 53, 54, 56, 57 rotate the axles 59, 61 upon which the cylindrical members 53, 54, 56, 57 are mounted. This energy is transmitted by the means 60 for transmitting to the truck 41. This provides the locomotion for the apparatus 10, whether forward or in reverse. To slow vehicle progress, the brakes 25, 26 on the train wheels may be engaged by engaging the vehicle brakes. Correspondingly, the slowing of the rotation of the drive wheels 6, 8 will effect a slowing in the apparatus 10.

When the user desires to leave the railway, the apparatus 10 should be positioned at an intersection or crossing with a roadway. The emergency brake 39 is engaged, the means 90 for stabilizing were lowered and the ramp 14 is attached. The means 30 for securing is released. The motor vehicle 2 is dismounted from the platform 12, and the roadwheels 70, 71 are extended. The ramp 14 is removed and placed in the means for holding, and the apparatus 10 is hitched to the vehicle 2 in conjunction with the means 90 for stabilizing.

With respect to the above description then, it is to be realized that the optimum dimensional relationships for the elements of the invention, to include the many variations for materials, deployment and the like, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described in the various embodiments, but rather that all suitable modifications and equivalents may be resorted to, falling with the scope and spirit of the invention.

Having, thus, set for the present invention, what is claimed is:

1. An apparatus to facilitate movement of a motor vehicle upon railways, the apparatus being capable of transit upon roadways by towing by the motor vehicle, the motor vehicle having a first set of wheels and a second set of wheels deployed thereon at a determined distance from the first set of wheels, the apparatus being capable of supporting the motor vehicle thereupon, the apparatus comprising:

(a) a platform upon which the motor vehicle may be mounted;

(b) a first set of train wheels attached to the platform;

(c) a second set of train wheels attached to the platform;

(d) adjustable means for engaging the roadway, the adjustable means enabling the apparatus to travel upon roadways when deployed in an extended condition, or to allow travel upon railways by the first and second sets of train wheels when deployed in a retracted condition;

(e) means for receiving a rotational energy from one set of wheels of the motor vehicle; and (f) means for transmitting the rotational energy from the means for receiving to one of the sets of train wheels.

2. The apparatus of claim 1, further comprising means for securing the motor vehicle upon the platform of the apparatus.

3. The apparatus of claim 1, further comprising a ramp releasably attachable to the platform.

4. The apparatus of claim 1, wherein the adjustable means for engaging the roadway comprises:

(1) a plurality of road wheels;

(2) a first arm upon which at least one of the road wheels is rotatively mounted;

(3) a second arm upon which at least one of the road wheels is rotatively mounted; and (4) means for deploying the road wheels in either the extended position or in the retracted position.

5. The apparatus of claim 4, wherein the means for deploying comprises:

(1) a stability rail mounted to the platform;

(2) a guide rail mounted to the platform adjacent to the stability rail, the guide rail having a threading disposed thereon;

(3) a first collar, the first collar being disposed around the stability rail and the guide rail, the first collar having a threading formed therein such that the threadings of the first collar and the guide rail are interdigitated;

(4) a first brace attached to the first arm;

(5) a first clevis pivotally connecting the first brace and the first collar;

(6) a second collar, the second collar being disposed around the stability rail and the guide rail, the second collar having a threading formed therein such that the threadings of the second collar and the guide rail are interdigitated;

(7) a second brace attached to the second arm;

(8) a second clevis pivotally connecting the second brace and the second collar; and (9) a crank comprising a handle and a shaft, the handle and the shaft being formed together substantially normal, the shaft being attached to the guide rail;

wherein the crank may be turned, thereby rotating the guide rail, the rotation of the guide rail moving the first and second collars thereon, the movement of the collars effecting either the extension or the retraction of the arms and thus the deployment of the road wheels attached thereto.

6. The apparatus of claim 1, further comprising a plurality of jacks mounted to the platform.

7. The apparatus of claim 1, wherein the means for receiving comprises:

(1) a first axle deployed on the platform;

(2) a second axle deployed on the platform, the second axle being connected with the means for transmitting;

(3) a first roller comprising:

(i) a first cylindrical member rotatively mounted upon the first axle;

(ii) a second cylindrical member rotatively mounted upon the second axle; and (iii) a track disposed around the first cylindrical member and the second cylindrical member;

(4) a second roller comprising:

(i) a third cylindrical member rotatively mounted upon the first axle;

(ii) a fourth cylindrical member rotatively mounted upon the second axle; and (iii) a track circumferentially disposed around the third cylindrical member and the fourth cylindrical member;

wherein either the first set of wheels or the second set of wheels of the motor vehicle are positioned upon the first roller and second roller, such that the motor vehicle may be run and the motor vehicle wheels allowed to rotate upon the rollers, the rotational energy generated by the wheels of the motor vehicle being received by the tracks of the rollers, causing the cylindrical members of the rollers to rotate, in turn causing the axles thereof to turn and receive the rotational energy, thereby imparting said rotational energy to the means for transmitting.

8. The apparatus of claim 1, wherein the means for transmitting comprises a continuously variable transmission connected to receive rotational energy from the means for receiving and relay said rotational energy to one of the sets of train wheels.

9. The apparatus of claim 4, further comprising:

(1) means for braking the train wheels;

(2) means for braking the road wheels; and (3) means for alternately engaging the means for braking the train wheels or the means for braking the road wheels.

10. The apparatus of claim 3, further comprising means for carrying the ramp, the means for carrying being formed on the platform.

11. The apparatus of claim 1, wherein the platform comprises:

(a) a first portion;

(b) a second portion, the second portion having an extended portion formed thereto, the extended portion telescoping into the first portion and supporting the first portion;

(c) means for releasably securing the first portion and the second portion of the platform.

12. The apparatus of claim 4, further comprising:

(a) means for securing the motor vehicle to the platform of the apparatus;

(b) a pair of jacks mounted to the platform;

(c) a ramp and means for carrying the ramp, the means for carrying being formed on the platform;

(d) means for braking the train wheels;

(e) means for braking the road wheels; and (f) means for engaging the means for braking the train wheels and the means for braking the road wheels; and (g) means for hitching the apparatus to the motor vehicle; and wherein the means for receiving comprises:

(1) a first axle deployed on the platform;

(2) a second axle deployed on the platform, the second axle being connected with the means for transmitting;

(3) a first roller comprising:

i) a first cylindrical member rotatively mounted upon the first axle;

ii) a second cylindrical member rotatively mounted upon the second axle; and iii) a track disposed around the first cylindrical member and the second cylindrical member;

(4) a second roller comprising:

i) a third cylindrical member rotatively mounted upon the first axle;

ii) a fourth cylindrical member rotatively mounted upon the second axle; and iii) a track circumferentially disposed around the third cylindrical member and the fourth cylindrical member;

wherein either the first set of wheels or the second set of wheels of the motor vehicle are positioned upon the first roller and second roller, such that the motor vehicle may be run and the motor vehicle wheels allowed to rotate upon the rollers, the rotational energy generated by the wheels of the motor vehicle being received by the tracks of the rollers, causing the cylindrical members of the rollers to rotate, in turn causing the axles thereof to turn and receive the rotational energy, thereby imparting said rotational energy to the means for transmitting; and wherein the means for deploying comprises:

i) a stability rail mounted to the platform;

ii) a guide rail mounted to the platform adjacent to the stability rail, the guide rail having a threading disposed thereon;

iii) a first collar, the first collar being disposed around the stability rail and the guide rail, the first collar having a threading formed therein such that the threadings of the first collar and the guide rail are interdigitated;

iv) a first brace attached to the first arm;

v) a first clevis pivotally connecting the first brace and the first collar;

vi) a second collar, the second collar being disposed around the stability rail and the guide rail, the second collar having a threading formed therein such that the threadings of the second collar and the guide rail are interdigitated;

vii) a second brace attached to the second arm;

viii) a second clevis pivotally connecting the second brace and the second collar; and ix) a crank comprising a handle and a shaft, the handle and the shaft being formed together substantially normal, the shaft being attached to the guide rail, wherein the crank may be turned, thereby rotating the guide rail, the rotation of the guide rail moving the first and second collars thereon, the movement of the collars effecting either the extension or the retraction of the arms and thus the road wheels attached thereto.

13. An apparatus to facilitate movement of a motor vehicle upon railways, the apparatus being capable of transit upon roadways by towing by the motor vehicle, the motor vehicle having a first set of wheels and a second set of wheels deployed thereon at a determined distance from the first set of wheels, the apparatus being capable of supporting the motor vehicle thereupon, the apparatus comprising:

(a) a platform having a forward end and a rearward end from which the motor vehicle may be mounted thereon;

(b) a first set of train wheels attached to the platform;

(c) a second set of train wheels attached to the platform;

(d) adjustable means for engaging the roadway, the adjustable means enabling the apparatus to travel upon roadways when deployed in an extended condition, or to allow travel upon railways by the first and second sets of train wheels when deployed in a retracted condition;

(e) a first means for receiving a rotational energy from the first set of wheels of the motor vehicle;

(f) a second means for receiving a rotational energy from the second set of wheels of the motor vehicle, the second means for receiving being deployed from the first means for receiving at a certain distance, the certain distance being substantially equal to the determined distance between the first set of wheels and the second set of wheels of the motor vehicle;

(g) a first means for transmitting the rotational energy from the first means for receiving to the first set of train wheels; and (h) a second means for transmitting the rotational energy from the second means for receiving to the second set of train wheels.

14. The apparatus of claim 13, further comprising a ramp releasably attachable to the platform at either its forward end or its rearward end.

15. The apparatus of claim 13, further comprising:

means for securing the motor vehicle to the platform after mounting thereon.

16. The apparatus of claim 13, wherein the adjustable means for engaging the roadway comprises:

(1) a plurality of road wheels;

(2) a first arm upon which at least one of the road wheels is rotatively mounted;

(3) a second arm upon which at least one of the road wheels is rotatively mounted; and (4) means for deploying the road wheels in either an extended position or in a retracted position.

17. The apparatus of claim 16, further comprising:

(1) means for braking the train wheels;

(2) means for braking the road wheels; and (3) means for alternately engaging the means for braking the train wheels or the means for braking the road wheels.

18. The apparatus of claim 16, wherein the means for deploying comprises:

(1) a stability rail mounted to the platform;

(2) a guide rail mounted to the platform adjacent to the stability rail, the guide rail having a threading disposed thereon;

(3) a first collar, the first collar being disposed around the stability rail and the guide rail, the first collar having a threading formed therein such that the threadings of the first collar and the guide rail are interdigitated;

(4) a first brace attached to the first arm;

(5) a first clevis pivotally connecting the first brace and the first collar;

(6) a second collar, the second collar being disposed around the stability rail and the guide rail, the second collar having a threading formed therein such that the threadings of the second collar and the guide rail are interdigitated;

(7) a second brace attached to the second arm;

(8) a second clevis pivotally connecting the second brace and the second collar; and (9) a crank comprising a handle and a shaft, the handle and the shaft being formed together substantially normal, the shaft being attached to the guide rail;

wherein the crank may be turned, thereby rotating the guide rail, the rotation of the guide rail moving the first and second collars thereon, the movement of the collars effecting either the extension or the retraction of the arms and the road wheels attached thereto.

19. The apparatus of claim 13, further comprising a plurality of jacks mounted to the platform.

20. The apparatus of claim 13, wherein each of the means for receiving comprises:

(1) a first axle deployed on the platform;

(2) a second axle deployed on the platform, the second axle being connected with one of the means for transmitting;

(3) a first roller comprising:
(i) a first cylindrical member rotatively mounted upon the first axle;
(ii) a second cylindrical member rotatively mounted upon the second axle; and
(iii) a track disposed around the first cylindrical member and the second cylindrical member;

(4) a second roller comprising:
(i) a third cylindrical member rotatively mounted upon the first axle;
(ii) a fourth cylindrical member rotatively mounted upon the second axle; and
(iii) a track circumferentially disposed around the third cylindrical member and the fourth cylindrical member;

wherein the first and second sets of wheels of the motor vehicle are positioned upon the first and second means of receiving, such that the motor vehicle may be run and the motor vehicle wheels allowed to rotate upon one of the means for receiving, the rotational energy generated by the wheels of the motor vehicle being received by the tracks of the rollers, causing the cylindrical members of the rollers to rotate, in turn causing the axles thereof to turn and receive the rotational energy, thereby imparting said rotational energy to each of the respective means for transmitting.

21. The apparatus of claim 14, further comprising means for carrying the ramp, the means for carrying being formed on the platform.

22. The apparatus of claim 13, further comprising means for altering the certain distance between the first means for receiving and the second means for receiving.

23. An apparatus to facilitate rail transit of a motor vehicle, the apparatus being capable of transit upon roadways by towing by the motor vehicle, the motor vehicle having a first set of wheels and a second set of wheels deployed thereon, the first set of wheels being deployed at a determined length from the second set of wheels, the apparatus being capable of supporting the motor vehicle thereupon, the apparatus comprising:

(a) a platform having a forward end and a rearward end, the platform being capable of receiving thereupon the motor vehicle;

(b) a ramp releasably attachable to the forward end of the platform or the rearward end of the platform, the ramp facilitating the mounting of the motor vehicle upon the platform;

(c) means for securing the motor vehicle to the platform after mounting upon the platform;

(d) a first means for receiving rotational energy from the first wheels of the motor vehicle, the first means for receiving comprising:
(1) a first axle deployed on the platform;
(2) a second axle deployed on the platform;
(3) a first roller comprising:
(i) a first cylindrical member rotatively mounted upon the first axle;
(ii) a second cylindrical member rotatively mounted upon the second axle; and
(iii) a first track disposed around the first cylindrical member and the second cylindrical member;
(4) a second roller comprising:
(i) a third cylindrical member rotatively mounted upon the first axle;
(ii) a fourth cylindrical member rotatively mounted upon the second axle; and
(iii) a second track circumferentially disposed around the third cylindrical member and the fourth cylindrical member;

(e) a second means for receiving rotational energy from the second wheels of the motor vehicle, the second means for receiving comprising:
(1) a third axle deployed on the platform;
(2) a fourth axle deployed on the platform;
(3) a third roller comprising:
(i) a fifth cylindrical member rotatively mounted upon the third axle;
(ii) a sixth cylindrical member rotatively mounted upon the fourth axle; and
(iii) a third track disposed around the fifth cylindrical member and the sixth cylindrical member;
(4) a fourth roller comprising:
(i) a seventh cylindrical member rotatively mounted upon the third axle;
(ii) a eighth cylindrical member rotatively mounted upon the fourth axle; and
(iii) a fourth track circumferentially disposed around the seventh cylindrical member and the eighth cylindrical member;

wherein the first and second sets of wheels of the motor vehicle are positioned upon the first and second means of receiving, such that the motor vehicle may be run and the motor vehicle wheels allowed to rotate upon the respective means for receiving, the rotational energy generated by the wheels of the motor vehicle being received by the tracks of the rollers, causing the cylindrical members of the rollers to rotate, in turn causing the axles thereof to turn and receive the rotational energy, thereby imparting said rotational energy to respective means for transmitting, the first means for receiving and the second means for receiving being deployed from each other at a distance, said distance being substantially equal to the distance between the first set of wheels and the second set of wheels of the motor vehicle;

(f) a first set of train wheels attached to the platform;

(g) a second set of train wheels attached to the platform;

(h) a first means of transmitting rotational energy from the first means for receiving to the first set of train wheels;

(i) a second means of transmitting rotational energy from the second means for receiving to the second set of train wheels;

(j) retractable means for engaging the roadway comprising:
(1) a plurality of road wheels;
(2) a first arm upon which at least one of the road wheels is rotatively mounted;
(3) a second arm upon which at least one of the road wheels is rotatively mounted; and
(4) means for alternately deploying the road wheels in an either extended position or in a retracted position, wherein the means for deploying comprises:
i) a stability rail mounted to the platform;
ii) a guide rail mounted to the platform adjacent to the stability rail, the guide rail having a threading disposed thereon;
iii) a first collar, the first collar being disposed around the stability rail and the guide rail, the first collar having a threading formed therein such that the threadings of the first collar and the guide rail are interdigitated;

iv) a first brace attached to the first arm;

v) a first clevis pivotally connecting the first brace and the first collar;

vi) a second collar, the second collar being disposed around the stability rail and the guide rail, the second collar having a threading formed therein such that the threadings of the second collar and the guide rail are interdigitated;

viii) a second clevis pivotally connecting the second brace and the second collar; and ix) a crank comprising a handle and a shaft, the handle and the shaft being formed together substantially normal, the shaft being attached to the guide rail, wherein the crank may be turned, thereby rotating the guide rail, the rotation of the guide rail moving the first and second collars thereon, the movement of the collars effecting either the extension or the retraction of the arms and thus the road wheels attached thereto;

(k) a plurality of jacks mounted to the platform;

(l) means for carrying the ramp, the means for carrying being formed on the platform;

(m) means for altering the distance between the first means for receiving and the second means for receiving, the means for altering thus changing the length of the platform and enabling the apparatus to accommodate motor vehicles having different determined lengths between the first set of wheels and the second set of wheels thereof;

(n) means for braking the train wheels;

(o) means for braking the road wheels;

(p) means for engaging the means for braking the train wheels and the means for braking the road wheels; and (q) means for hitching the apparatus to the motor vehicle.

* * * * *